US006102141A

United States Patent [19]

Engström et al.

[11] Patent Number: 6,102,141

[45] Date of Patent: Aug. 15, 2000

[54] ROCK DRILL HAVING AN INTERNAL FLUSHING CHANNEL

[75] Inventors: Håkan Engström, Gävle; Jan-Gunnar Hedlund, Sandviken, both of Sweden; Göran Palmberg, Radovia Raposo Tavares, Brazil

[73] Assignee: Sandvik AB, Sandviken, Sweden

[21] Appl. No.: 09/148,993

[22] Filed: Sep. 8, 1998

[30] Foreign Application Priority Data

Sep. 5, 1997 [SE] Sweden ..... 9703197

[51] Int. Cl.[7] ..... E21B 10/38

[52] U.S. Cl. ..... 175/417; 175/320; 175/415

[58] Field of Search ..... 175/417, 414, 175/320, 21, 415

[56] References Cited

U.S. PATENT DOCUMENTS 3,295,613 1/1967 Anderson .

4,226,290 10/1980 McSweeney ..... 175/320

4,852,672 8/1989 Behrens ..... 175/389

*Primary Examiner*—David Bagnell

*Assistant Examiner*—Zakiya Walker

*Attorney, Agent, or Firm*—Burns, Doane, Swecker & Mathis, L.L.P.

[57] ABSTRACT

A rock drill for percussive drilling includes a shank, a collar connected to a front end of the shank, and a rod portion which at one end connects to the collar while the other end carries a rock cutting means. A central flush channel extends from the front free end of the shank in a direction towards the front end. The central flush channel has a substantially constant diameter (d) along essentially its entire length; a ratio of the diameter (d) to a smallest outer cross sectional width (D) of the rod portion being in the range of 0.35 to 0.43.

5 Claims, 3 Drawing Sheets

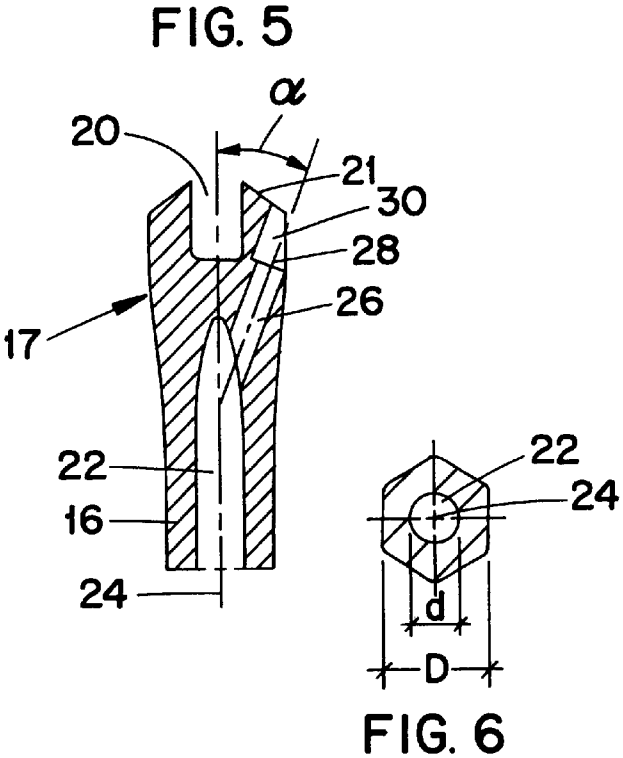
FIG. 5
FIG. 6
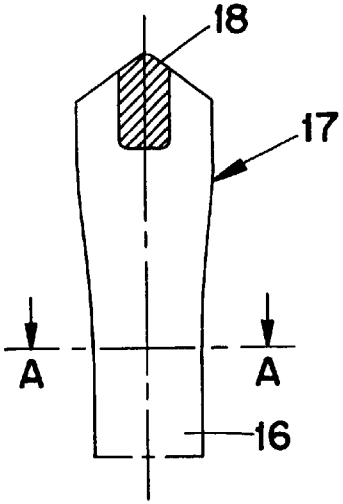
FIG. 3
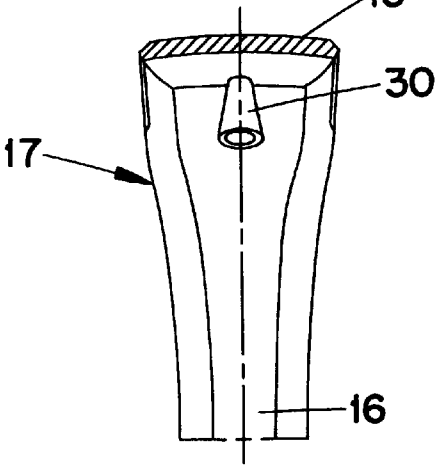
FIG. 2
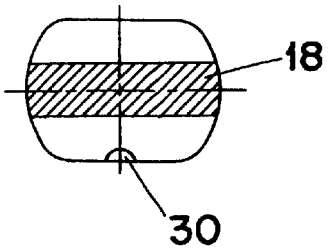
FIG. 4

ROCK DRILL HAVING AN INTERNAL FLUSHING CHANNEL

TECHNICAL AREA OF THE INVENTION

The present invention relates to a rock drill for percussive drilling, which has a shank, a collar connecting to one end of the shank, a rod portion, a first end of which connects to the collar while a second end carries rock cutting means, and a central flush channel which extends from the free end of the shank towards said second end. The invention also relates to a method for manufacturing such a rock drill.

PRIOR ART

Integral drill rods have been available on the market for a long time and are consequently outstanding mature products. The known integral drill rods are embossed by the technique which has been developed for hand held drills where safety for the operator has been the most critical requirement. Nowadays automatic rigs are used more and more, wherein the operator sits protected in a control hut. The known integral drill rods have not been much adapted to the change in the sense of the operational technique which the introduction of automatic rigs have brought. The drawbacks with known integral drill rods are, inter alia, that they do not flush away the drill dust in a satisfactorily manner, they have too low penetration rate, they become too hot, and it is difficult to blast-away burrs from a surface of the flush channel. Because of that difficulty of internal blasting, many burrs remain in the flush channel, which results in poor flushing, i.e. deficient cooling of the integral drill rod, which thereby becomes too hot, which in turn may result in fatigue breakdown.

The conventional manufacturing of integral drill rods starts with a blank which is provided with a predrilled longitudinal center hole of a certain diameter. The blank then has been annealed, whereafter the diameter of the center hole has been reamed to a limited extent in the longitudinal direction, from the end where the shank is formed. The reason for reaming is to enable the drilled center hole, functioning as a flushing hole, to receive a flushing tube projecting from certain drill machines. That tube has such a diameter that it could not be contained in the original (non-reamed) longitudinal center hole of the blank. When the reaming of the longitudinal center hole is completed, i.e. the flush channel has been formed, then forging, drilling and milling operations of the shank/collar and the drill bit end are performed. The shank of a known integral drill rod is shown partly sectioned in the enclosed FIG. 8.

Furthermore U.S. Pat. No. 3,295,613 discloses a composite drill rod wherein separate portions are welded together.

OBJECTS AND FEATURES OF THE INVENTION

The object of the present invention is to provide a rock drill of the above defined type, which is less expensive to manufacture than known integral drill rods. An additional object of the present invention is to achieve an improved performance compared to the known integral drill rods, i.e. the integral drill rod according to the present invention has a higher penetration rate compared to known integral drill rods. Said higher penetration rate is attained by the integral drill rod according to the present invention which provides an improved flushing compared to known integral drill rods.

The above-indicated objects are realized by a rock drill for percussive drilling. The rock drill comprises a shank, a collar connected to a front end of the shank, a rod portion extending forwardly from a front end of the shank, a rock cutter disposed at a front end of the rod portion, and a central flush channel extending from a rear end of the shank toward the front end of the rod portion. The shank, collar, and rod portion are formed as an integral one-piece unit. The flush channel has a substantially constant diameter along substantially it's entire length. A ratio of a diameter of the flushing channel to a smallest outer cross sectional width of the rod portion is greater than 0.35 and less than 0.43.

Preferably, there is at least one branch channel extending from the central flush channel and terminating in a front free surface of the rod portion. The branch channel forms an angle with the central flushing channel in a range of 20–30°.

The present invention also pertains to a method of manufacturing a rock drill for percussive drilling. The method comprises the steps of:

A) providing a blank having a predrilled longitudinal center hole, wherein a ratio of a diameter of the center hole to a minimum outer cross sectional width of the rod portion is in the range of 0.35 to 0.43; and B) forming a rear shank and a collar on the blank.

BRIEF DESCRIPTION OF THE DRAWINGS

The objects and advantages of the invention will become apparent from the following detailed description of a preferred embodiment thereof in connection with the accompanying drawing in which like numerals designate like elements, and in which:

FIG. 2 is a view of a front portion of the rock drill according to the present invention which has at least one cutting insert;

FIG. 3 is a side view of the rock drill according to FIG. 2;

FIG. 4 shows an end view of the end of a rock drill according to the present invention which has at least one cutting insert;

FIG. 5 depicts a longitudinal section through the rock drill according to FIG. 2, wherein the cutting insert has been left out;

FIG. 6 shows a section taken along line A—A in FIG. 3;

DETAILED DESCRIPTION OF A PREFERRED EMBODIMENT OF THE INVENTION

Figure 1A:
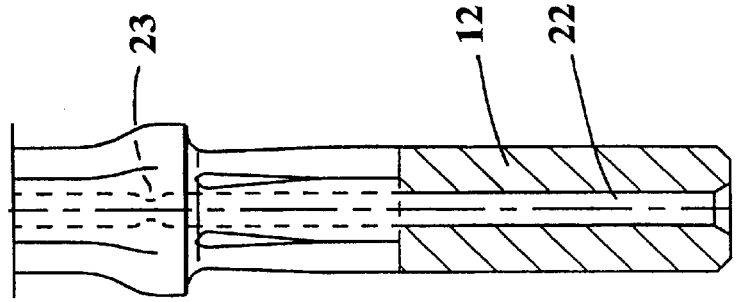
FIG. 1*a* shows a partly sectioned plan view of the shank of the rock drill according to FIG. 1.
Figure 8:
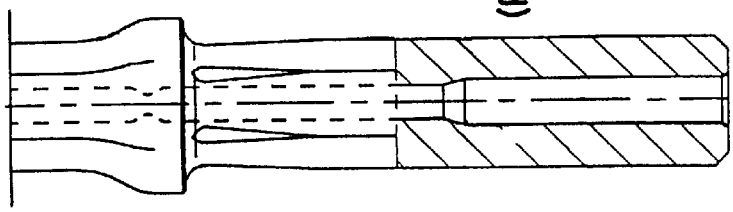
FIG. 8 (PRIOR ART)
FIG. 8 depicts a partly sectioned view of a prior art rock drill.

The rock drill 10 according to the present invention (shown in FIG. 1) comprises a shank 12, a collar 14, a rod portion 16 and at least one cutting insert 18 provided at the free end of the rod portion 16, i.e. at the free rock cutting end surface 17 of the rock drill 10. The shank 12, the collar 14 and the rod portion 16 are preformed as a one-piece blank. The shank 12 has a cross section which is adapted to the internal cross section of a drill sleeve (not shown) in a drill machine. Normally, the shank 12 has a polygonal cross section and in the shown embodiment the shank has a hexagonal cross section. The shank 12 according to the present invention is however in no manner limited to having a polygonal cross section. It is merely necessary that the cooperating cross sections of the shank 12 and the drill sleeve are designed such that the shank 12, i.e. the rock drill 10, is rotated when the drill sleeve rotates.

Also the rod portion 16 according to the preferred embodiment has a hexagonal cross section.

Figure 1:
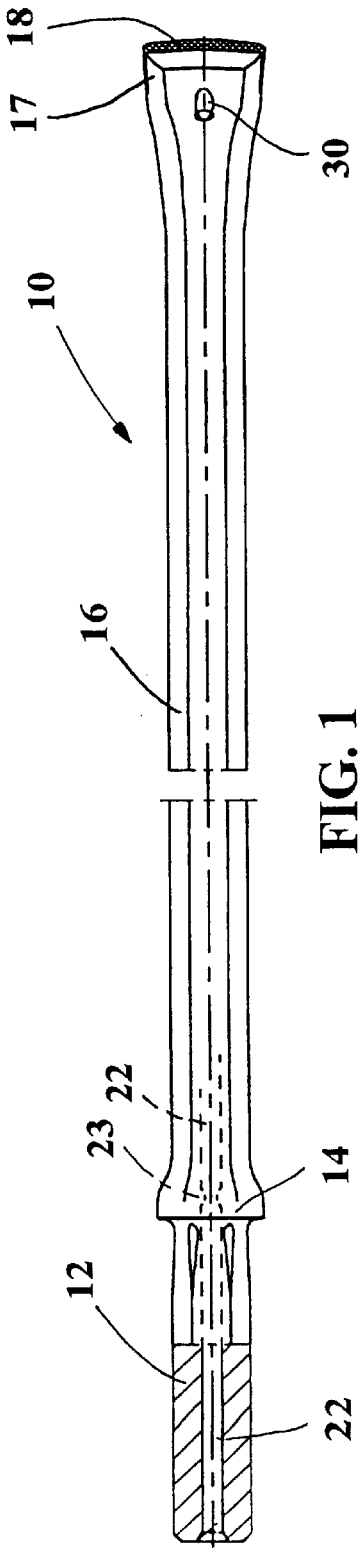
FIG. 1 depicts a partly sectioned view of a rock drill according to the present invention.

In FIG. 1*a*, a detail of the shank 12 of the rock drill 10 is shown, wherein is evident that a central flush channel 22 extends from the free end of the shank 12 in a direction towards the free rock cutting end 17 of the rock drill 10, see also FIG. 1.

In FIGS. 2–4 are shown details in different views of the rock cutting end portion 17 of the rock drill 10 which carries the cutting insert 18. The cutting insert 18 in the shown embodiment is a chisel, which in a usual manner rests in a recess 20, see FIG. 5, and secured in said recess 20, preferably by soldering.

From FIG. 5 it is evident how the central flush channel 22, which is symmetrical with respect to a first longitudinal central line 24 of the rock drill 10, extends longitudinally and terminates at a distance from the end surface 21 of the rod portion 16 and also at a distance from the bottom of the recess 20. That is, the central flush channel includes an end wall closing-off a front end of the central flush channel. Said flush channel 22 extends rearwardly from the front end thereof shown in FIG. 5 through the entire rod portion 16 and further past the collar 14 and through the entire shank 12 until it opens into the rear free end of the shank 12, see FIGS. 1 and 1*a*.

As shown in FIG. 5, a branch channel 26 extends from the front of the central flush channel 22 and terminates in a recess 30 in the area of the end surface 21 of the rod portion 16. The branch channel 26 is symmetrical with respect to a second longitudinal central line 28. The angle $\alpha$ between said second central line 28 and the first central line 24 lies within the interval of 20–30° with a preferred value for $\alpha$ of about 25°.

As shown in FIG. 6, the central flush channel 22 has a diameter d along essentially its entire length while the rod portion 16 has a smallest outer cross sectional width which is depicted by D. According to a preferred embodiment of the present invention a drill with an external smallest outer cross sectional width D of 22 mm has a diameter d of 9.0 mm at the central flushing channel. These dimensions result in a relationship d/D=0.41, which is the most preferred value of said relationship. Within the limits of the invention the following relationship is preferred: $0.35 \leqq d/D \leqq 0.43$.

The method of manufacture of the above described integral drill rod 10 is different from the method of manufacture of known integral drill rods, which was described previously herein. Both the integral drill rod according to the present invention and known integral drill rods originate from a blank, which has a predrilled longitudinal center hole. A distinguishing feature in the manufacture of the integral drill rod according to the present invention is that no annealing and reaming of the center hole for a limited longitudinal extent is necessary. Instead, the predrilled center hole is dimensioned such that the flushing tube present in certain drill machines can be received by said predrilled longitudinal center hole, i.e. the relationship (d/D) between the diameter of the predrilled longitudinal center hole and the external cross sectional width of the drill is bigger than in known integral drill rods. Since neither annealing nor reaming of the predrilled longitudinal center hole is necessary, the manufacture of an integral drill rod according to the present invention can be started by forging the shank/collar and then forging the drill bit end. In this connection it shall be pointed out that when the shank/drill bit end is forged, a mandrel (not shown) is placed in the central flush channel 22, said mandrel having a somewhat less diameter than the flush channel 22. During the forging operation the mandrel ensures that the diameter of the central flushing channel 22 is not reduced too much. However a certain reduction is performed at a region 23 depicted in FIGS. 1 and 1*a*. Notwithstanding this reduction, it can be stated that the flushing channel 22 has a substantially constant diameter (d) along essentially its entire length. The subsequent steps of manufacturing are in principle the same as for known integral drill rods.

In this connection, however, it shall be noted the following. According to both the prior art and the present invention the branch channel 26 has a somewhat less diameter than the central flush channel 22. The reason for this is to ensure that even if, during drilling of the branch channel 26, an exact centering of the second central line 28 of the branch channel-relative to the first central line 24 of the central flushing channel 22 is not attained, the circumference of the branch channel 26 at its junction with the central flush channel 22 will still be located inside the circumference of the latter. Also, if this diametrical difference is maintained, the branch channel 26 can have an actual size which is bigger than in a corresponding integral drill rod according to the prior art since the central flush channel 22 of the integral drill rod according to the present invention is bigger than in a corresponding prior art integral drill rod. This is advantageous for minimizing the pressure drop of flushing fluid.

Since both the central flush channel 22 and the branch channel 26 have bigger absolute sizes than in corresponding prior art integral drill rods, the blasting of the inner surface of said channels is promoted and especially the transition between said channels where known integral drill rods often have burrs which disturb the transport of flushing medium. Because of the enlarged channel cross sections, the blasting becomes more efficient since the blasting material gets better accessibility. It is understood that the improved blasting leads to an improved transport of flushing medium, which in turn promotes cooling of the drill and thereby diminishes the risk for fatigue breakdown.

FUNCTION OF THE DRILL ACCORDING TO THE INVENTION

The integral drill rod 10 according to the present invention is used for so called percussive drilling, i.e. an impact piston impacts on the rear free end of the shank 12 and a shock wave propagates through the drill to the free end of the rod portion 16 where the cutting insert 18 is located. The cutting insert 18 is thrown by the impact wave against the rock surface, whereby cutting of the same occurs. Rotation of the integral drill rod 10 occurs via the above described drill sleeve.

Heat is generated during percussive drilling when the impact wave propagates through the rock drilling as well as drill cuttings when the cutting insert 18 machines the rock surface. Flush medium, i.e., air or water, is supplied under pressure at the front free end of the shank 12 via the central flush channel 22 to cool the rock drill 10 and to flush away drill cuttings. The flush medium flows forwardly in the central flush channel 22 in a direction towards the front free end of the rod portion 16 and is deflected into the branch channel 26 to flow out from the recess 30 at the area of the free end of the rod portion 16, more exactly, beside the cutting insert 18. The flush medium will, during its flow in the central flush channel 22 and in the branch channel 26, cool the rock drill 10 while the flush medium, when returning from the front free end of the rod portion 16, transports drill cuttings.

Since the relationship d/D for the present rock drill 10 is bigger than for known integral drill rods, wherein the measure d has been increased while the measure D is maintained unaltered, a smaller pressure drop is attained when flush medium flows through the central flush channel, which brings an improved cooling of the rock drill 10 compared to the prior art. The reduced pressure drop in the flush medium also brings an improved flushing away of the drill dust. The cross section of the branch channel 26 is bigger in actual size than in a corresponding integral drill rod according to the prior art which is likewise favorable for reducing the fall of pressure, i.e., the pressure drop is limited.

Since the angle $\alpha$ (about 25°) between the flush channel 22 and the branch channel 26 has a smaller value as compared to known integral drill rods, less deflection of the flush flow occurs when it flows from the central flush channel 22 to the branch channel 26. This means that the flush medium flow is not as interrupted as in known integral drill rods where a bigger deflection is at hand. This promotes enforcement of a low pressure drop for the flush medium when it passes through the integral drill rod 10.

To sum up, it can be stated that despite the fact that the increase of the value of the relationship d/D means that more material has been removed from the drill compared to a corresponding drill according to the prior art, i.e., the drill according to the invention has a reduced rigidity, any added propensity for example for fatigue breakdown has not been shown. One theory is that the improved flushing/cooling which the drill according to the present invention achieves, compensates for the reduced rigidity.

CONCEIVABLE MODIFICATIONS OF THE INVENTION

Figure 7:
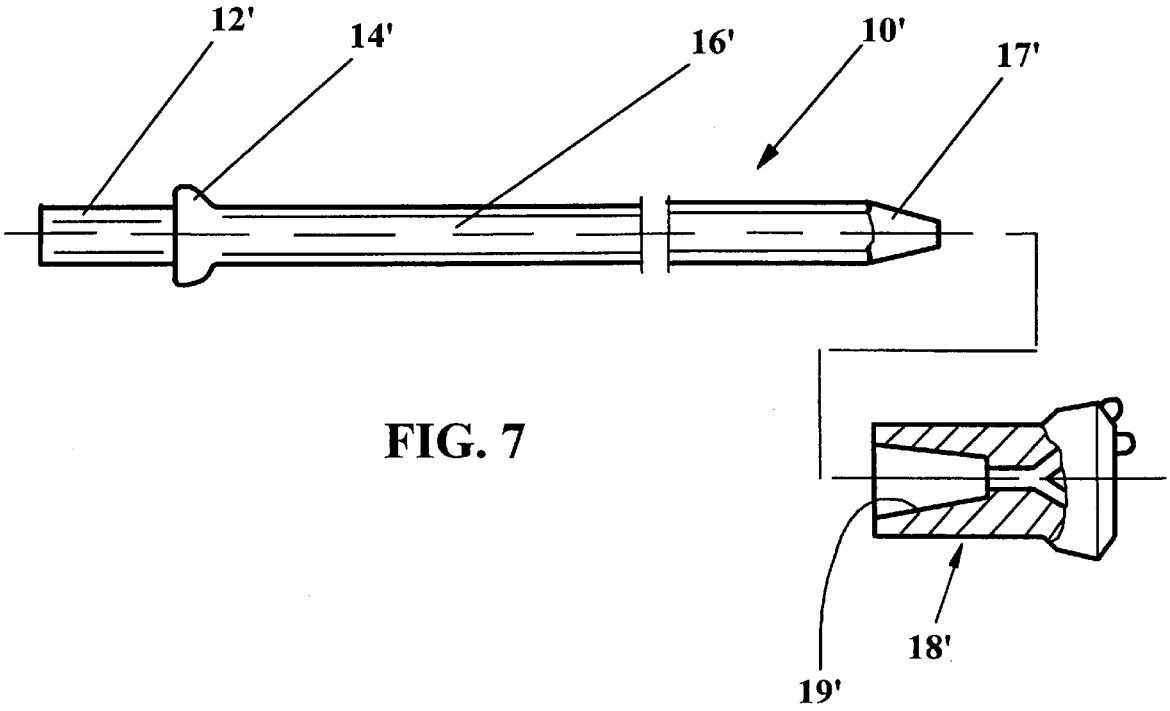
FIG. 7 shows a partly sectioned exploded view of a conical rod for rock drilling.

The invention has been described above with reference to a so called integral drill rod. The invention is however in no manner limited to such a drill rod. In FIG. 7 there is shown a multi-piece percussive rock drill comprising a so called conical rod 10', which likewise has a shank 12', a collar 14' and a rod portion 16' with a cone shaped end 17'. Said rock drilling 10' is characterized in that the rod portion 16' and a drill bit 18' (cone bit) are joined via a conical joint, i.e. the cone shaped end surface 17' is received in a cone shaped recess 19' of the drill bit 18'. This means that the drill bit 18' can be exchanged when it is worn-out or needs regrinding. The invention is applicable also to this type of drill rod, i.e. the central flush channel (not shown) in the rock drill 10' has a substantially constant diameter along essentially its entire length. The same diametrical reductions in connection with forging of the shank/collar as described above in connection with the integral drill rod can be achieved in the multi-piece drill rod.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A rock drill for percussive drilling, comprising a shank; a collar connected to a front end of the shank; a rod portion extending forwardly from the collar; a rock cutter disposed at a front end of the rod portion; and a central flush channel extending from a rear end of the shank toward the front end of the rod portion; the shank, the collar and the rod portion forming an integral one-piece unit; the flush channel being of circular cross sectional shape and having a substantially constant diameter along substantially its entire length; a ratio of a diameter of the flushing channel to a smallest outer cross sectional width of the rod portion being greater than 0.35 and less than 0.43, the central flush channel including an end wall closing off a front end thereof; and at least one branch channel extending outwardly from the central flush channel for conducting flushing fluid to a front end of the rock drill.

2. The rock drill according to claim 1 wherein the ratio is substantially 0.4.

3. The rock drill according to claim 1 wherein the at least one branch channel terminates in a front free surface of the rod portion, the branch channel forming an angle with the central flushing channel in a range of 20–30°.

4. The rock drill according to claim 3 wherein the angle is substantially 25°.

5. The rock drill according to claim 1 wherein the at least one branch channel terminates in a recess disposed in the front free end surface of the rod portion.

* * * * *